US007486900B2

(12) United States Patent
Omata

(10) Patent No.: US 7,486,900 B2
(45) Date of Patent: Feb. 3, 2009

(54) IMAGE FORMING APPARATUS CAPABLE OF REMOVING TONER FROM A TONER REMOVING MEMBER

(75) Inventor: Haruhiko Omata, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 61 days.

(21) Appl. No.: 11/144,706

(22) Filed: Jun. 6, 2005

(65) Prior Publication Data

US 2005/0276620 A1 Dec. 15, 2005

(30) Foreign Application Priority Data

Jun. 9, 2004 (JP) ..... 2004-171182

(51) Int. Cl.
*G03G 15/00* (2006.01)

(52) U.S. Cl. ..... 399/49; 399/314

(58) Field of Classification Search ..... 399/49, 399/101, 99, 313, 314
See application file for complete search history.

(56) References Cited

U.S. PATENT DOCUMENTS 5,970,281 A * 10/1999 Park ..... 399/101
6,016,418 A * 1/2000 Kabeya et al. ..... 399/314
6,173,135 B1 1/2001 Yuminamochi et al. ..... 399/66
6,175,711 B1 * 1/2001 Yoshino et al. ..... 399/297
2003/0026623 A1 * 2/2003 Hoshika ..... 399/49

FOREIGN PATENT DOCUMENTS

| | | |
|---|---|---|
| JP | 2000-29281 | 1/2000 |
| JP | 2000-187405 | 7/2000 |
| JP | 2002-72697 | 3/2002 |
| JP | 2002-229411 | 8/2002 |
| JP | 3432355 | 5/2003 |
| JP | 2003-233259 | 8/2003 |

* cited by examiner

*Primary Examiner*—David M Gray
*Assistant Examiner*—Ruth N Labombard
(74) *Attorney, Agent, or Firm*—Fitzpatrick, Cella, Harper & Scinto

(57) ABSTRACT

An image forming apparatus capable of variably controlling a condition with which toner sticking to a transcription member for transferring a toner image from an image bearing member onto a transcription medium, is transferred onto the image bearing member, in accordance with a history of a toner image formed on the image bearing member, is provided by electrostatically transferring toner sticking to the transcription member onto the image bearing member.

5 Claims, 6 Drawing Sheets

IMAGE FORMING APPARATUS CAPABLE OF REMOVING TONER FROM A TONER REMOVING MEMBER

BACKGROUND OF THE INVENTION

1. Field of the Invention

The present invention relates to an electrophotographic type image forming apparatus, which uses a transcription member making contact with an image bearing member, for electrostatically transferring a toner image from the image bearing member onto a recording medium, and which has a toner removing means for electrostatically removing toner sticking to a transcription means.

2. Description of the Related Art

It has been long desired even in an electrophotographic type image forming apparatus to enhance the quality of a printed image. Accordingly, an image forming apparatus using a transcription member making contact with an image bearing member, for transferring a toner image onto a recording medium is provided therein with a toner removing member for electrostatically removing toner sticking to the transcription member.

The removal of toner sticking to the transcription member can prevent toner from sticking to a transcription medium on a surface on the side remote from a surface on which an image is formed. Further, a method of electrostatically removing toner can reduce abrasion or the like of the transcription member during removal of the toner.

However, continuous removal of toner from a transcription member, with the use of a toner removing member for electrostatically removing toner sticking to the transcription member, has caused such a problem that the toner builds up on the toner removing member, which is therefore unable to remove the toner.

SUMMARY OF THE INVENTION

Accordingly, an object of the present invention is to provide an image forming apparatus capable of stably removing toner from a transcription member by removing toner built up on a toner removing member for electrostatically removing toner from the transcription member.

To the end, according to the present invention in one aspect, there is provided an image forming apparatus comprising:

an image bearing member;

a toner image forming means for forming, on the image bearing member, a toner image which is charged with a predetermined polarity;

a bearing member toner removing means for removing toner from the image bearing member;

a transcription member making contact with the toner bearing member, for electrostatically transferring the toner image from the image bearing member onto a transcription medium in a transcription zone;

a toner removing member for electrostatically removing the toner sticking to the transcription member and charged with the predetermined polarity;

an electric field creating means for creating an electric field between the image bearing member and the transcription member, and between the transcription member and the toner removing member, the electric field creating means creating an electric field such that the toner image charged with the predetermined polarity is exerted thereto with an electrostatic force in a direction from the toner removing member to the transcription member and a direction from the transcription member to the image bearing member; and an execution means for carrying out a mode for shifting the toner sticking to the toner removing member, onto the image bearing member.

Further features and advantages of the present invention will become apparent from the following description of exemplary embodiments with reference to the accompanying drawings.

DESCRIPTION OF THE EMBODIMENTS

According to the present invention, an electric field is formed in such a way that toner sticking to a fur brush (toner removing member) 42 is exerted thereto with an electrostatic force in a direction from the fur brush 42 to a secondary transcription roller (transcription member) 41 and in a direction from the secondary roller to an intermediate transcription belt (image bearing member) 130. Further, the toner sticking to the fur brush 42 is shifted onto the intermediate transcription belt 130. Thus, the toner sticking to the fur brush 42 can be removed. Accordingly, the fur brush 42 can stably remove toner sticking to the secondary transcription roller 41.

A detailed explanation will be hereinbelow made of preferred embodiments of the present invention.

Embodiment 1

Figure 1:
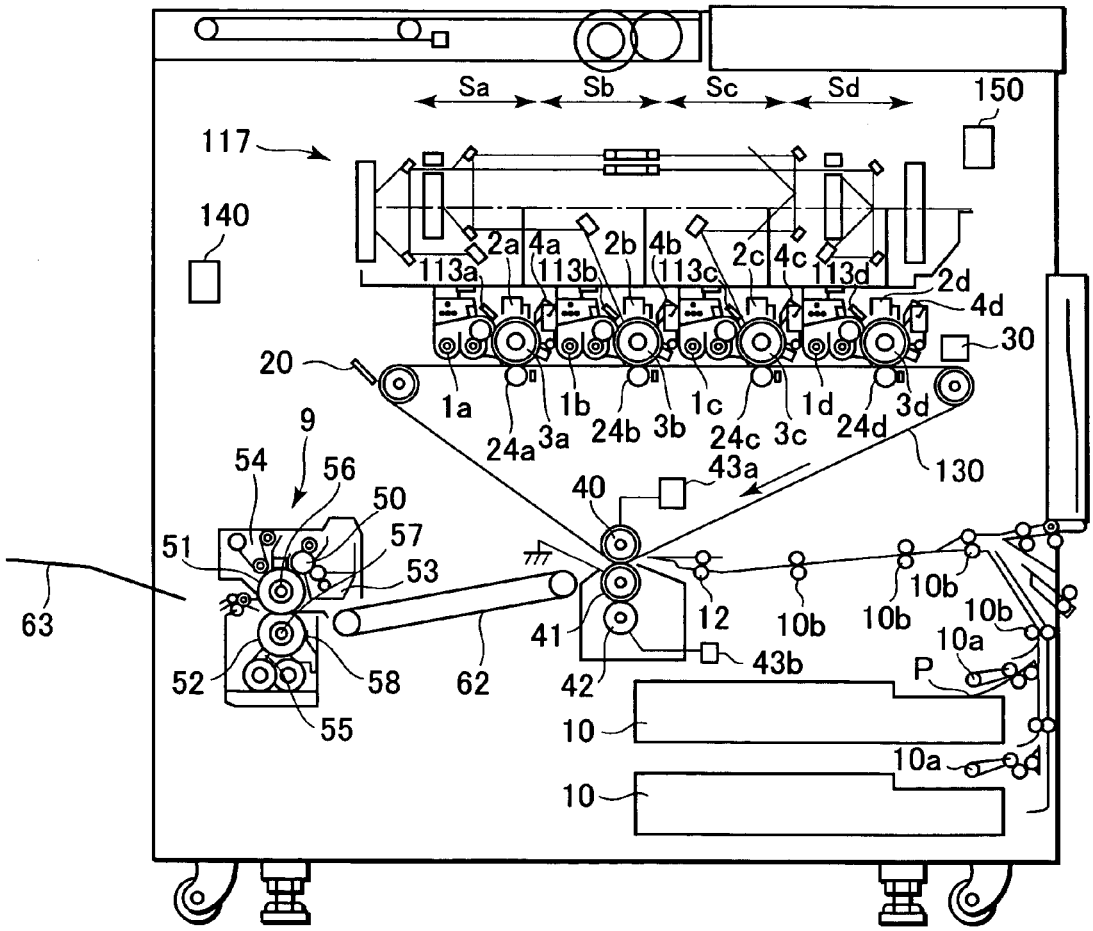
FIG. 1 is a schematic sectional view illustrating an embodiment of an image forming apparatus according to the present invention.

An in-line and intermediate transfer type image forming apparatus as shown in FIG. 1 is exemplified, as an example of the image forming apparatus in which this embodiment is applied.

Referring to FIG. 1, an image forming apparatus, which is a four color type full color laser printer, incorporates an intermediate transfer belt 130 on which developer images (toner images) are superposed one upon another, and four image forming portions, that is, a first (yellow) image forming portion Sa, a second (magenta) image forming portion Sb, a third (cyan) image forming portion Sc and a fourth (black) image forming portion Sd, which are arranged in the mentioned order from the upstream side along the rotating direction of the intermediate transfer belt 130.

The first to fourth image forming portions S (Sa, Sb, Sc, Sd) respectively have drum-type electrophotographic photosensitive bodies (photosensitive drums) 3 (3*a*, 3*b*, 3*c*, 3*d*) on which color developer images (toner images) are formed respectively.

Each of the image forming portions S is provided therein with a drum electrifier (electrifying means) 2 (2*a*, 2*b*, 2*c*, 2*d*), a potential sensor 113 (113*a*, 112*b*, 113*c*, 113*d*), a developing unit (developing means) 1 (1*a*, 1*b*, 1*c*, 1*d*) as a toner image forming means, a primary transcription roller 24 (24*a*, 24*b*, 24*c*, 24*d*) as a primary transcription member, and a cleaner 4 (4*a*, 4*b*, 4*c*, 4*d*) for the photosensitive drum 3, which are arranged around the photosensitive drum 3. Further, in the upper part of the image forming apparatus body, there is provided a laser beam scanner as an exposure unit (electrostatic image forming means) 117, which is composed of a light source, a polygon mirror and the like.

The exposure unit 117 carries out scanning by rotating the polygon mirror with a laser beam emitted from the light source. The scanning beam is then deflected by a reflection mirror and is then converged onto a generating line on the photosensitive drum 3 by an fθ lens so as to carry out exposure. Thus, an electrostatic latent image is formed on the photosensitive drum 3, which is charged with negative polarity by the drum electrifier 2.

The developing units are replenished with developers by predetermined quantities within the respective image forming portions S by a supply unit (not shown). That is, the developing unit 1*a* is filled therein with yellow toner, the developing unit 1*b* with magenta toner, the developing unit 1*c* with cyan toner and the developing unit 1*d* with black toner. The toners in these developing units are charged with negative polarity. The developing units 1 develop electrostatic latent images on the photosensitive drums 3 in the respective image forming portions. That is, a yellow toner image, a magenta toner image, a cyan toner image and a black toner image, which are charged with negative polarity are developed (visualized).

The toner images formed on the photosensitive drums 3 are consecutively transferred onto the intermediate transcription belt 130 by applying voltages with positive polarity to the primary transcription rollers 24 so as to feed current with negative polarity, which is reverse to that of the toners in the respective image forming portions S.

Figure 3:
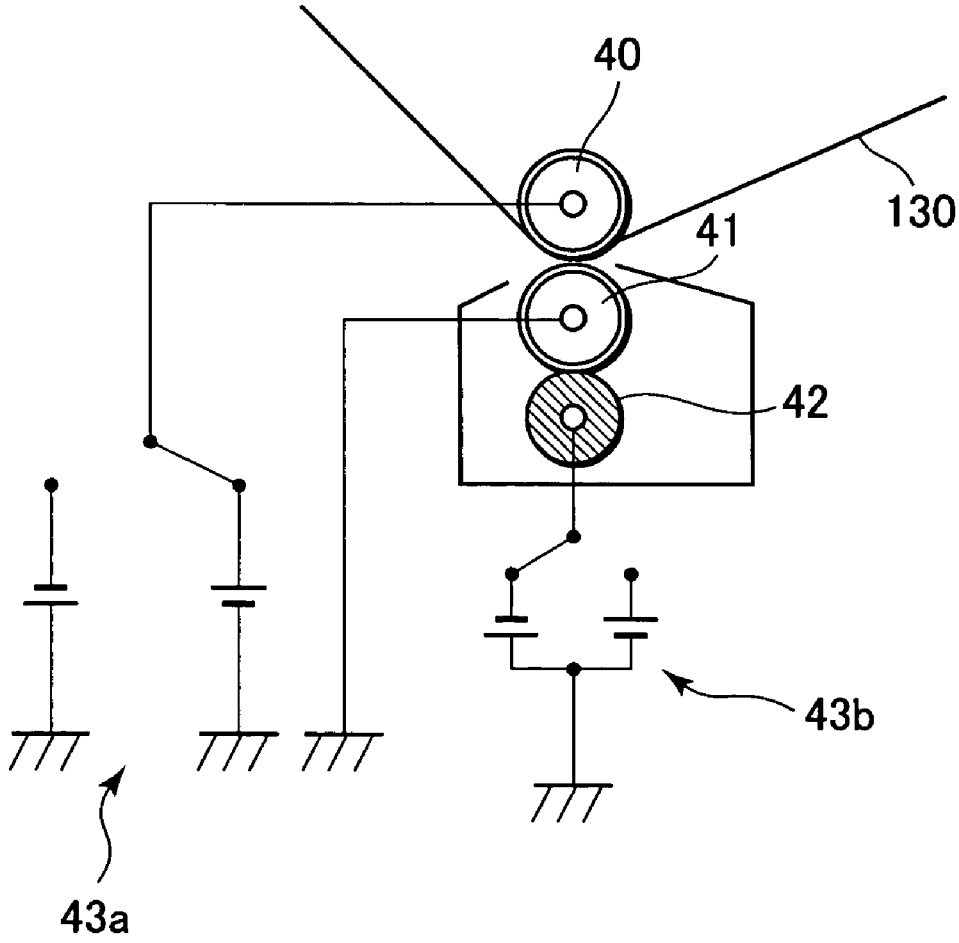
FIG. 3 is a sectional view of a transcription member, a fur brush and those therearound as an example.

The toner images superposed on the intermediate transfer belt 130 are transferred onto a recording medium P in a batch. In this embodiment, as a secondary transcription member for carrying out the above-mentioned secondary transcription, there are provided a transcription platen roller 40 and a secondary transcription roller 41 in pair between which the intermediate transcription belt 130 is interposed. The transcription platen roller 40 is the one on which the secondary transcription belt 130 is wound while the intermediate transcription roller 41 in pair with the platen roller 40 is arranged being opposed to the latter through the intermediary of the intermediate transcription belt 130. This transcription roller 40 pinches the recording medium P against the intermediate transcription belt 130 so as to convey the same while the toner image is transferred from the intermediate transcription belt 130 onto the recording medium P. In this embodiment, the transcription platen roller 40, which is one of rollers wound thereon with the intermediate transcription belt 130 is connected thereto with a power source (electric field creating means) 43*a* capable of switching between positive and negative polarities, as shown in FIG. 3. Applied thereto is a bias having negative polarity, which is the same as the polarity of the toner image during transcription, thereby the transcription process is carried out. In this embodiment, the toner image is charged with negative polarity. Accordingly, the negative bias is applied to the transcription platen roller 40 during transcription. The secondary transcription roller 41 opposed to the transcription platen roller 40 and located outside of the intermediate transcription belt 130 is grounded. That is, a transcription electric field is created between the transcription platen roller 40 and the secondary transcription roller 41.

The recording medium P is accommodated in a recording medium cassette 10, and is fed from one of the cassettes 10 to the secondary transcription portion (transcription zone) between the secondary transcription roller 41 and the intermediate transcription belt 130 by way of feed rollers 10*a*, a plurality of conveying rollers 10*b*, and a registration roller 12.

The intermediate transcription belt 130 is made of a dielectric resin sheet, such as polyethylene terephthalate resin sheet (PET resin sheet), a polyvinyliden fluoride resin sheet or polyurethane resin sheet, having its opposite ends are overlapped and joined with each other so as to be formed into an endless configuraton. Alternately, it is formed of an endless belt without a joint, that is, a seamless belt. The belt 130 has, in general, volumetric resistivity of $10^9$ to $10^{16}$ Ω.cm.

The recording medium P on which the toner image has been transferred is conveyed by a conveying portion 62 into the fixing unit 9. The fixing unit 9 is composed of a fixing roller 51, a press roller 52, heat resistant cleaning members 54, 55 for cleaning the former rollers, roller heating heaters 56, 57 respectively accommodated in the fixing roller 51 and the press roller 52, a coating roller 50 for coating a surface lubricant, such as dimethyl silicone oil over the fixing roller 51, an oil sump 53 for the surface lubricant, and a thermistor 58 for detecting a temperature of the surface of the press roller 52 in order to control the fixing temperature.

The recording medium P on which the four color toner images have been transferred, is subjected to fixation so as to mix the toner images and to fix the same onto the recording medium P, resulting in the formation of a full color image. Thus, the recording medium P is discharged onto a discharge tray 63, as an image bearing product.

Residual toner on the photosensitive drums 3 is cleaned off (or removed) from photosensitive drums 3 with which the transcription has been completed, in the respective image forming portions S, and is then used for next image formation.

In this embodiment, a cleaning blade (image carrier toner removing means) 20 as a cleaning means for the intermediate transcription belt 130 abuts thereagainst so as to scrape residual toner and the like off the outer surface of the intermediate transcription belt 130 by means of the cleaning blade 20.

In the image forming apparatus in this embodiment, patches (toner images for detection) as developer images for controlling images, that is, density control patches in this embodiment, are formed on the intermediate transcription belt 130. Accordingly, a control means 140 variably controls a condition with which the above-mentioned image forming process is carried out (an image forming condition). In the image formation by the image forming apparatus, a density and a hue of a formed image would vary, depending upon a change in a use environment, a change in an area of a formed image or a number of formed images. As the main causes of the above-mentioned matters, there may be considered various facts such that toner absorbs moisture in the environment so as to change its electrifying characteristic, the consumption and the supply of toner become unbalanced so as to change the electrifying characteristic or a temperature in the apparatus body rises so as to change resistance values of several components. In order to constrain the above-mentioned density variation, the density control patches are periodically formed so as to detect densities thereof in order to carry out such a control that replenishing quantities of the toners are changed, electrifying potentials of the photosensitive drums 3 are changed or developing potentials are changed.

Latent images of patches are formed on the drums 3 in such a manner that patch image signals based upon desirable or objective image patterns, which have been stored in memory provided in a control means (not shown) for controlling the operation of the image forming means in the image forming apparatus are delivered to a drive means (not shown) in the exposure unit serving as a latent image forming unit and incorporating a light source and a polygon mirror in each of the image forming portions S so as to form latent images of patches on the photosensitive drums 3. There may be exemplified solid images having maximum densities (maximum density patches), halftone images and the like outputted by the image forming apparatus, as a patch image pattern for the patches used as the density control patches. In this embodiment, halftone images having a reflection density of 1.0 are formed as the density control patches.

The latent images of the patches are formed on the photosensitive drums 3, which have been primarily charged in uniform thereover, similar to the above-mentioned normal image forming process, and are developed by the developing units 1. Thus, density control patches having different colors are formed in the respective image forming portions S.

These density control patches are also transferred onto the intermediate transcription belt 130 by the primary transcription roller 24, similar to the normal images. Since the density control patches are already being used for a test pattern without being produced as image bearing products, they may be usually produced on the outer surface of the photosensitive drums 3 or the intermediate transcription belt 130 as an image bearing member, outside of an image forming zone thereof. Thus, although densities of patches formed on the photosensitive drums 3 may be detected by density sensors, densities of patches formed on the intermediate transcription belt 130 are detected by density sensors (toner detecting means) 30 in this embodiment, and the image control is carried out.

Further, since the density patches are formed outside of the image forming zones, the timing of formation thereof is set between successive image formation processes for two recording mediums P during successive image formation, that is, within a so-called inter-sheet zone or an interval between a last time and a present time of rotation during a period in which image formation is carried out.

Figure 2A:
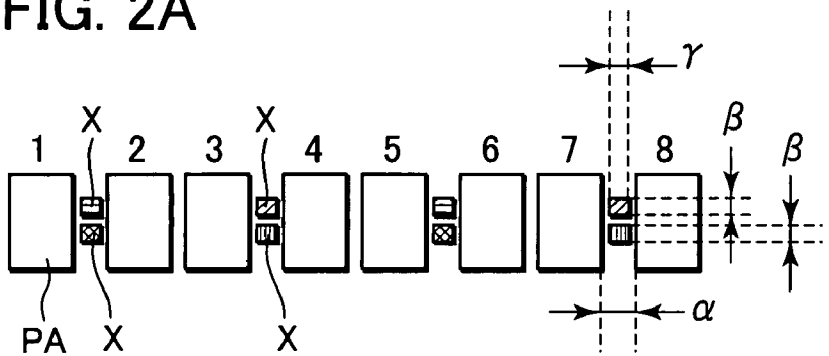
FIGS. 2A and 2B are illustrations for explaining a relationship between a position of an ordinary image and a position of an image control developer image on an intermediate transcription medium.
Figure 2B:
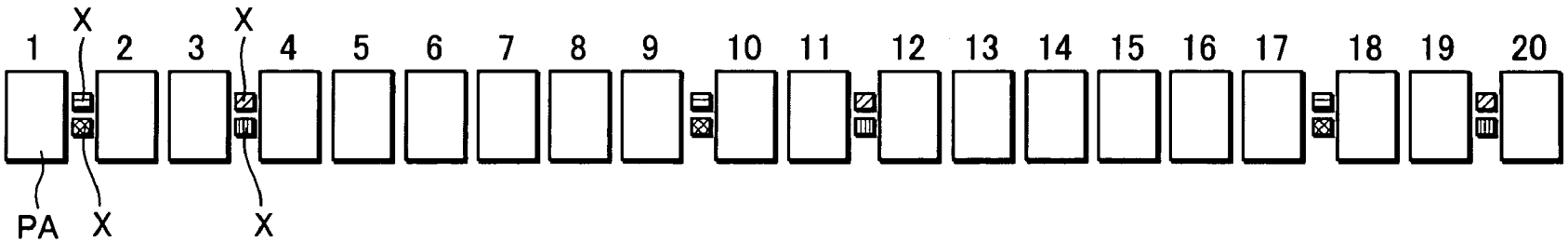

It is noted that if the density control patch is printed during rotation after completion of an image formation, it is preferable to carry out such a control that a density of a density control patch is detected (monitored) by the density sensor 30 facing the intermediate transcription belt 130. Then, the transcription platen roller 40 is preferably applied thereto with a reverse bias in order to prevent the density control patch from being transferred onto the secondary transcription roller 41 since the time during which the reverse bias can be applied is sufficient. Thus, the patch which has been formed during the rotation after image formation is prevented from being transferred onto the secondary transcription roller 41, and can be removed by the cleaning blade 20 serving as a means for cleaning the intermediate transcription belt 130, similar to the normal image formation process. FIG. 2 shows a positional relationship between the image position PA and the density control patch X in the embodiment 1. Further, FIG. 2*b* shows a positional relationship between the image position PA and the density control patch X in an embodiment 2 which will be described later. Further, numbers attached to image positions PA exhibit the order of images formed at the respective image position PA. That is, For example, in FIG. 2A, the density patches X are formed between image positions 1 and 2, between image positions 3 and 4, between image positions 5 and 6 and image positions 7 and 8, respectively.

In the image forming apparatus in this embodiment, the density control patches X are formed between sheets during successive image formation in order to increase the throughput. Referring to FIGS. 2A and 2B, which exhibit a relationship between an image position PA on the intermediate transcription belt 130 for forming an image on the recording medium, and the density control patches X on the intermediate transcription belt 130, the respective colors patches are once formed for formation of four images.

In this embodiment, two density sensors 30 are juxtaposed with each other in a direction orthogonal to the traveling direction of the intermediate transcription belt 130 (thrust direction). Thus, positions where patches X are formed by two image forming portions S are set so that the patches X are juxtaposed with each other in the thrust direction, facing the density sensors 30. Accordingly, densities of two color images formed by the two color image forming portions S can be once read. Thus, the density control of all colors can be completed with two times, in total, of formation and density detection of patches, that is, two colors at once.

Thus, the density control patches X (toner images for detection) are formed on the intermediate transcription belt 130. Image densities are read by the density sensors 30 provided downstream of the image forming portions S in the traveling direction of the intermediate transcription belt. The thus read image density signals are transmitted to the control means for feeding back the signals for toner replenishing quantities and developing bias in order to stabilize the image densities.

In this embodiment, intervals of the image positions PA on the intermediate transcription belt 130, that is, as shown in FIGS. 2A and 2B, intervals ($\alpha$) of sheets are set to 40 mm at minimum. Since the dimensions of the density control patches X are 20 mm×20 mm ($\beta\times\gamma$), that is, the length thereof is 20 mm in the traveling direction of the intermediate transcription belt 130. Since the process speed is 200 mm/sec, the time by which the inter-sheet zone of the intermediate transcription belt 130 passes through the secondary transcription portion is 200 ms. By subtracting the time of passing through the density control patches from this value, 100 ms is obtained.

In general, since about 100 ms is required for allowing a high voltage source to stably output its power from the time when it is energized, it cannot afford any time, in the inter-sheet zone, for carrying out such a control that the bias applied to the transcription roller 40 is changed from negative polarity into positive polarity and is then returned into negative polarity. That is, sufficient time is not available for changing over the power source in order to prevent transcription onto the secondary transcription roller 41 making direct contact with the patch forming surface of the intermediate transcription belt 130.

That is, since it is difficult to change over the bias applied to the secondary transcription roller 40 within the inter-sheet zone as to the patches formed in the inter sheet zone, the patches in the zone cannot be removed only by the cleaning blade, similar to the patches during post-rotation.

Thus, the patches formed in the inter-sheet zone are transferred onto the secondary transcription roller 41, which is located outside of the intermediate transcription belt 130 in the secondary transcription portion. An explanation will be hereinbelow made of the cleaning for the secondary transcription roller 41 on which the patches X have been transferred, with reference to FIG. 3, together with a situation around the secondary transcription roller 41.

In addition to the above-mentioned density control patches X, waste toner, such as blurring toner sticking to those other than the recording medium positions PA or scattering toner from the developing unit 1, sticks to the secondary transcription roller 41. Should cleaning of the waste toner be insufficient, it would stick to the back surface of the recording medium P, resulting in contamination of the back surface.

Thus, the secondary transcription roller 41 is cleaned by the fur brush 42, which is provided making contact with the periphery of the secondary transcription roller 41. The fur brush 42 is connected thereto with a bias applying means or the power source (electric field creating means) 43*a* capable of a change-over between negative polarity and positive polarity. During normal image formation for transferring a toner image onto the recording medium P, a positive bias having a polarity reverse to that of the toner is applied to the fur brush 42, which therefore removes the waste toner sticking to the secondary transcription roller 41. The thus removed toner is taken into the fur brush 42.

In such a cleaning sequence that the toner accumulated in the fur brush 42 is removed, a negative bias reverse to that during the normal image formation is applied. Accordingly, the waste toner is returned from the fur brush 42 to the secondary transcription roller 41, and is then returned onto the intermediate transcription belt 130 by reversing the polarity of the bias applying means for the transcription platen roller 40, that is, the power source 43*a*. The waste toner having been returned on the intermediate transcription belt 130 is cleaned off therefrom by the cleaning blade 20.

In order to carry out the operation of cleaning by the fur brush, as shown in FIG. 3, the image formation is interrupted as soon as a predetermined quantity of the toner is accumulated in the fur brush 42. A negative bias is applied to the fur brush 42 while a positive bias is applied to the transcription platen roller 40 in order to return the waste toner accumulated in the fur brush 42, onto the intermediate transcription belt 130.

In this embodiment, during cleaning of the fur brush 42, the bias to be applied is set to 20 μA upon positive control, but −20 μA upon negative control. Further, the time of the negative control is set to 1 min. with which no image formation can be made, the shorter the time, the more the convenience. It is preferable to select a minimum time with which the quantity of toner in the fur brush 42 is sufficiently reduced.

Should the normal image formation be continued while the image control is carried out by forming patches in the above-mentioned inter-sheet zone without carrying out the sequence, and should the application of the positive bias to the fur brush 42 be continued, the toner overflows in the fur brush 42, resulting in occurrence of contamination of the back surface of the recording medium P. Further, even though the quantity of toner in the fur brush is not large, continuous application of the positive bias causes the toner in the fur brush to be charged so as to gradually change from the positive polarity into the negative polarity, also resulting in occurrences of contamination of the back surface of the recording medium P.

It has been found that the contamination of the back surface occurs when the number of the density control patches becomes fifty for the toner accumulated in the fur brush 42 in a part in the thrust direction. Thus, after the image formation of forty patches has been made, the image formation is interrupted, and the cleaning sequence of the fur brush is carried out by applying a bias having a polarity which is reverse to that during transcription.

As stated above, in this embodiment, since the sensors are located at two positions in the thrust direction, when the formation of the patches X on the intermediate transcription belt 130 comes into a condition as shown by FIG. 2A, with one time of density detection for four colors, the waste toner is fed to the fur brush 42 by a quantity corresponding to two patches. If the patches are formed with another timing, for example, if one time of density control is carried out every ten patches, it is set so as to carry out the cleaning sequence once per 200 sheets.

That is, in this embodiment, it is determined, the larger the number of times of patch formation, the larger the quantity of the toner sticking to the fur brush. Accordingly, the timing of carrying out the cleaning operation of the fur brush is controlled, depending upon a number of times of patch formation.

It is noted here that the timing with which the density control patches are formed, is dependent upon such a condition that the density becomes unstable. For example, in a condition in which the volume of image data is less so that the consumption of the toner is less, no frequent density control is required.

However, if the image data is large so that the toner is consumed by a large quantity, the image density becomes unstable since the quantity of consumption does not balance with the supply quantity. Thus, frequent density control is required. Further, as stated above, a size of a recoding medium and a variation in the environment of use also cause the image density to be unstable.

Specifically, the density control is carried out once for five sheets in the case of 10% of the image data, but once for ten sheets for 5% of the image data with a A4-size sheet. The higher the frequency of image control, the larger the number of patches should be discarded, and accordingly, the consumption of the toner is increased, or the number of times of maintenance for discarding the toner is increased. Thus, it is preferable to avoid the density control to the extent possible.

In this embodiment, data of the timing with which the density control patches are printed is incorporated in the apparatus body. It may be set by the user so that the frequency of the density control is increased if a variation in the density should be deeply taken care, but the frequency of the density control is decreased if a variation in the density should not be so deeply taken care.

Meanwhile, since the quantity of the waste toner fed to the fur brush 42 does not substantially cause occurrences of blurring toner or scattering toner in comparison with the quantity of toner for the density control patches, that is, it is mainly dependent upon a number of times of formation of density control patches. Thus, should the fur brush be cleaned, depending upon a number of images with the above-mentioned timing, the image formation would be interrupted even though the toner is not appreciably accumulated in the fur brush 42. That is, it has been found that wasteful down-time is caused.

Accordingly, the inventors studied the number of times of formation of the density control patches and a condition of occurrences of contamination of the back surface as stated above, and have found that cleaning may be made in accordance with a number of times of formation of the density control patches.

That is, the minimum frequency of the density control is obtained when an image having not greater than 2.5% of image data with an A4 size sheet is printed. At This stage, the timing with which the cleaning sequence is carried out is once every 20 sheets. Even with this condition, after the waste toner corresponding to forty patches is cleaned off, the cleaning mode for the fur brush 42 can prevent occurrences of contamination of the back surface. This corresponds to once every 400 sheets as to the number of formed images.

Meanwhile, in the case of the maximum density control, it is once carried out every four sheets, and accordingly, the fur brush is once cleaned every eighty sheets.

That is, by controlling the number of times of cleaning in accordance with a number of times of the density control, the frequency of interruption of the image formation can be lowered, at maximum, down to once every 400 sheets with a configuration in which the cleaning is once carried out every fixed number of eighty sheets.

Accordingly, it is determined that by counting the number of times of the density control with a CPU, the cleaning of the fur brush is carried out when the number of times of the density control attains a predetermined value, that is, when the number of the density control patches becomes a predetermined number.

Figure 4:
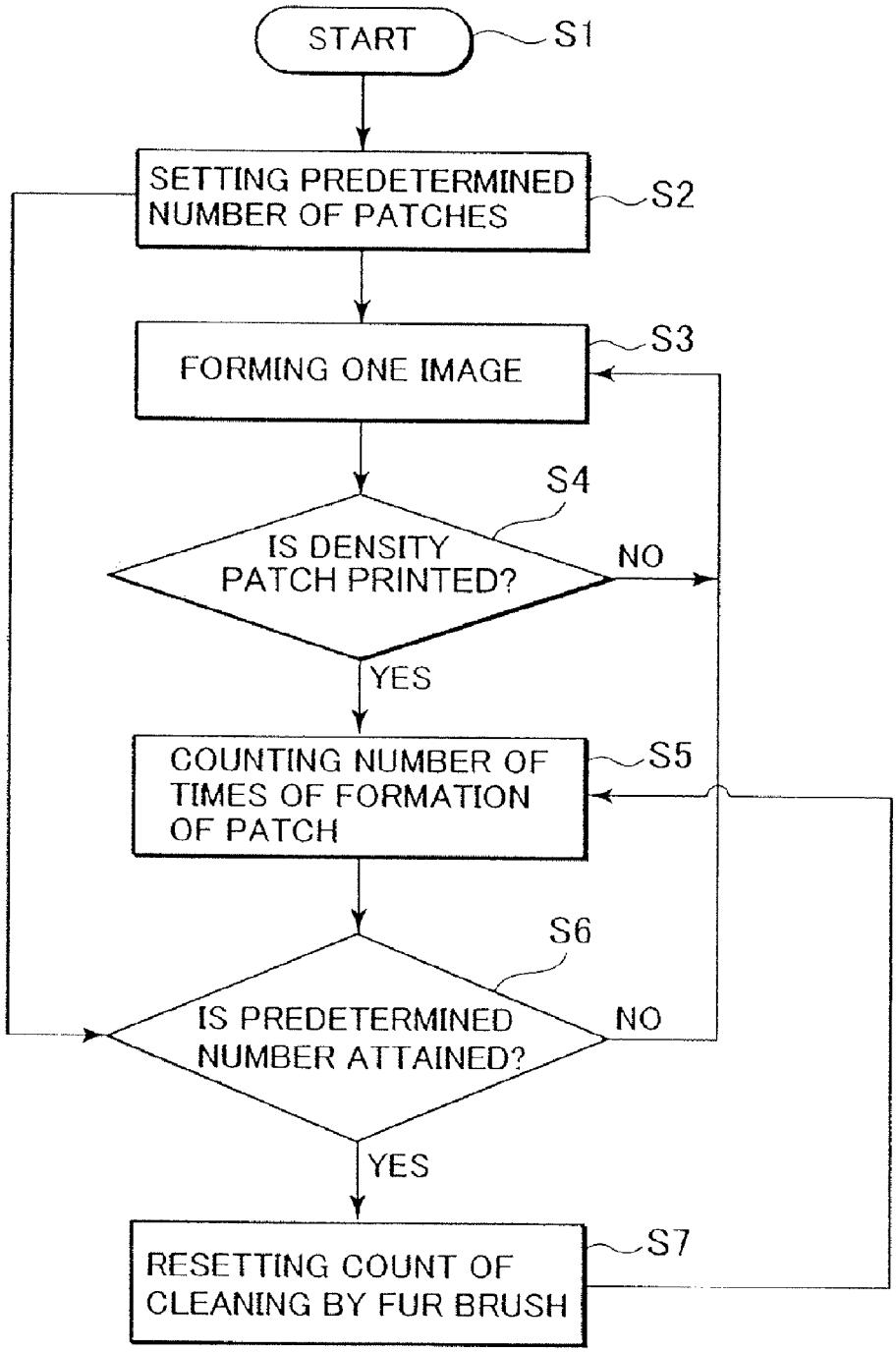
FIG. 4 is a flowchart in an example of a control process for determining a timing with which a fur brush cleaning operation is carried out.

The above-mentioned control is shown in the form of a flowchart in FIG. 4. In this flowchart, a control is carried out with steps S1 to S7. If the number of times of the patches is set to 40 (S2), it is counted up to 40 (S2 to S5), and when it becomes 40 (S6), a bias is applied for removing the waste toner from the fur brush 42 (S7)

In this embodiment, the toner image quantity as a condition in which the timing of carrying out the cleaning operation of the fur brush is determined corresponds to the number of times of formation of the density control patches. However, the toner image quantity should not be always limited to this condition. Rather, it may correspond to a condition in correlation to a quantity of toner sticking to the fur brush, to a video count value or an image rate of normal images formed on the intermediate transcription belt 130 or the photosensitive drum 3. A condition for determining the timing with which the cleaning operation of the fur brush is carried out, may include a parameter depending upon a variation in the environment of use of the image forming apparatus, in addition to the condition in correlation to the quantity of toner sticking to the fur brush. Further, it may be adjusted in accordance with a size of sheets or image data.

Further, as to the patches, although the density control patches are formed in this embodiment, there may be possibly formed patches, which have been formed for another purpose, such as those for detecting color deviation, or those for discharging developer from the developing unit 1 for the renewal of the developer. It is noted here that the cleaning mode for cleaning the fur brush in accordance with a history of the formation of toner image (a quantity of residual toner) is carried out by the execution means 150.

As stated above, by applying a bias having polarity reverse to that during normal image formation to the fur brush 42, the toner accumulated in the fur brush 42 is returned to the secondary transcription roller 41 from which it is further returned onto the intermediate transcription belt 130. Thus, the removal of the toner accumulated in the fur brush 42 is completed.

It has been found that the fur brush can stably remove the toner sticking to the secondary transcription roller 41.

Further, since the cleaning sequence can be reduced by monitoring the condition relating to the waste toner accumulated in the fur brush 42, the frequency of interruption of the image formation can be reduced. Thus, there can be provided an image forming apparatus, which can surely remove toner accumulated in the fur brush 42 without excessively reducing the throughput of the image forming apparatus.

It is noted in this embodiment that the two rollers 40, 41 are opposed to each other, the intermediate transcription belt 130 being interposed therebetween, in the secondary transcription portion in which the recording medium P makes contact with the intermediate transcription belt 130. A transcription bias is applied to the roller 40 inside of the intermediate transcription belt 130 while the roller 41 outside thereof is grounded. Thus, although the fur brush 42 applied thereto with a voltage can preferably prevent the transcription bias from deviating, a bias having polarity reverse to that of the toner, as the transcription bias, can be applied to the roller 41 making contact with the intermediate transcription belt 130.

Further, according to the present invention, the inline system in which the number of patches is increased, is used. However, the present invention can be also applied to an image forming apparatus having a single photosensitive drum or a monochromatic image forming apparatus. Further, the present invention can be applied to an image forming apparatus of an electrostatic recording type. Further, it can be applied to not only an image forming apparatus of an intermediate transcription type but also an image forming apparatus of a direct transcription type. This configuration will be again explained in embodiments 5 and 6.

Embodiment 2

The basic configuration and the image forming operation of an image forming apparatus in this embodiment are similar to those of the embodiment 1, except that two kinds of density control patches having densities of 1.0 and 0.6 are formed in the apparatus in this embodiment.

Thus, the density control with several densities can further stabilize the density in a halftone area. In this embodiment, two kinds of density control patches are alternately formed.

An explanation has been made of such a configuration that the density control patch having a density of 1.0 is printed by 40 times in the embodiment 1. Since a toner quantity per unit area is 0.3 mg/cm$^2$ for a patch having a density of 1.0, and since the area of the patch is 4 cm$^2$, the toner quantity of a singe patch having a density of 0.1 is 1.2 mg. A sequence is carried out in such a way that, when, for example, 48 mg of toner corresponding to forty batches is accumulated in the fur brush 42, the toner is discharged from the fur brush 42.

That is, by setting the toner quantity of a patch having a density of 1.0, to 1.2 mg while the toner quantity of a patch having a density of 0.6, to 0.72 mg, the total toner quantity is calculated by summing. When the total toner quantity becomes 48 mg, a sequence for discharging the toner in the fur brush is carried out. Even with the use of this control, it has been found that satisfactory results can be obtained. With this configuration, the timing with which patches are formed would not always be regular but possibly would be irregular.

It is noted that intervals with which the density control is carried out may be stored in a memory in the apparatus, or may be set by the user. The image density for the density control should not be limited to those stated above, but several densities may be used.

As stated above, since the cleaning sequence can be reduced by monitoring a quantity of waste toner accumulated in the fur brush 42, it is possible to reduce the number of times of interruption of image formation.

Accordingly, the toner accumulated in the fur brush 42 can be surely removed. Further, there can be provided an image forming apparatus, which can surely remove toner accumulated in a fur brush without excessively lowering the throughput of the image forming apparatus.

Embodiment 3

The basic configuration and image forming operation of this embodiment are the same as those of the embodiment 1.

As stated above, the patches may have various objects, that is, as to the patches used for the density control patches, a patch having a maximum density is formed or a halftone image is formed.

In this embodiment, the density control is carried out with a halftone having a density of 0.6 in consideration with importance of the gradation in a half tone area where the density is low. In comparison with the embodiment 1, the quantity of the waste toner fed to the fur brush 42 is decreased. Accordingly, the frequency of execution of the cleaning sequence of the fur brush 42 is also decreased.

However, although the quantity of toner accumulated in the fur brush 42 can be decreased in comparison with that in the embodiment 1, it has been found that contamination of the back surface possibly occurs. This is caused because the tribo-electricity of the waste toner is gradually changed from negative polarity into positive polarity due to application of a positive bias to the fur brush 42 when the secondary transcription roller 41 being cleaned. Accordingly, the toner having the tribo-electricity, which has been changed into the positive polarity is returned onto the secondary transcription roller 41 although the quantity of the waste toner is less. As a result, it has been found that contamination of the back surface occurs.

With further detailed examination, it has been found that the change of the tribo-electricity depends on a current applied during transcription.

Accordingly, by applying a minimum quantity of electric charge required for cleaning off the waste toner sticking to the secondary transcription roller 41, to the fur brush 42, the reversal of the above-mentioned tribo-electricity can be restrained to a minimum value. Accordingly, the quantity of toner accumulated in the fur brush 42 can be increased. Thereby, it is possible to reduce the frequency of the cleaning for the fur brush 42. That is, if the bias applied to the fur brush 42 is controlled with a constant current, the quantity of the toner held in the fur brush 42 can be increased, thereby it is possible to reduce the frequency of the cleaning.

Specifically, although it has been explained in the embodiment 1 that a positive current of 20 μA is applied to the fur brush 42 during cleaning of the secondary transcription roller 41, the secondary transcription roller 41 can be cleaned by applying a current of 12 μA to the fur brush 42 in this embodiment since the density of the density control patch is low. Thus, by changing a current value, the reversal of the tribo-electricity of the toner can be limited to a minimum value, thereby it is possible to increase the quantity of the toner held in the fur brush 42.

An explanation will be made of the cleaning of the secondary transcription roller 42 with a constant current. It has been known that the resistance value of the secondary transcription roller 41 is deteriorated through energization thereof. Thus, if a bias is applied to the fur brush 42 through constant voltage control, a current required for the cleaning can be ensured when the resistance of the secondary transcription roller 41 is low. As the resistance of the secondary transcription roller 41 is increased, the current running therethrough is decreased, resulting in occurrences of inferior cleaning.

Thus, there is provided such a configuration that the application of the bias current to the fur brush 42 is carried out through constant current control in order to prevent occurrences of inferior cleaning even though the resistance value of the secondary transcription roller 41 is changed.

As stated above, with application of the bias to the fur brush 42 through constant current control and with execution of optimum control in accordance with a density of the density control patch, the quantity of toner held in the fur brush 42 can be increased. Accordingly, it is possible to reduce the frequency of the cleaning of the fur brush 42.

Accordingly, it is possible to provide an image forming apparatus which can surely remove the toner accumulated in the fur brush 42 without excessively decreasing the throughput thereof.

Embodiment 4

The basic configuration and image forming operation of an image forming apparatus in this embodiment are the same as those of the image forming apparatus in the embodiment 3.

It can be said in the embodiment 3 that the merit, which can be obtained by the constant current control for cleaning the secondary transcription roller 41 is such as to ensure a required current even though the resistance value of the secondary transcription roller 41 or the fur brush 42, that is, the resistance value of the member through which the current runs is changed.

Meanwhile, when variation in toner quantity or nonuniformity in the thrust direction occurs due to partial contamination of the secondary transcription roller 41 or increase of blurring toner caused by an unexpected reason such as jamming, the resistance value of a part to which toner sticks is increased due to the resistance of the toner. Accordingly, the current can hardly run therethrough so that the current running through a part where no toner is present is increased. That is, a part of the current fed from a high voltage transducer under the constant current control runs through a part where no toner is present. Thereby, it is raised such a problem that a current required for cleaning the part to which the toner sticks cannot be ensured correspondingly.

If the constant voltage control for the bias applied to the fur brush 42 is used in order to solve the above-mentioned problem, there may be obtained such a merit that a current required for cleaning off the density control patches can be ensured, irrespective of the presence of toner, that is, irrespective of local variation in impedance.

Accordingly, a current running through the transcription platen roller 40 applied thereto with a secondary transcription bias, and a voltage applied thereto are detected. The resistance value of the secondary transcription roller 41 is determined from a result of the detection in view of the relationship between resistance values of the transcription platen roller 40 and the secondary transcription roller 41, which has been previously examined. Further, a voltage value applied to the fur brush 42 through the constant voltage control is determined in accordance with the resistance value. Thereby it is possible to eliminate the above-mentioned problem.

Specifically, in the case of controlling the transcription platen roller 40 with a constant current of 40 μA, the applied voltage varies in a range of about 2.8 to 4 KV due to an increase in the resistance due to aging effect. At this stage, the voltage for feeding a desired current to the fur brush 42 is changed in a range of +500 to +1,200 V. By examining this change in detail, the relationship between the voltage to be applied to the transcription platen roller 40 and the voltage to be applied to the fur brush 42 is stored as data in a memory in the apparatus, and the voltage of the fur brush 42 is determined in accordance with the data.

With this configuration, it is possible to prevent occurrences of inferior cleaning of the secondary transcription roller 41 even though the constant voltage control. The intervals of the cleaning for toner accumulated in the fur brush 42 is set, similar to that in the embodiment 2.

It has been explained in this embodiment that the numerical values as mentioned above are used, the present invention should not be limited these numerical values, but it is also changed in accordance with the resistance values of the secondary transcription roller 41 and the intermediate transcription belt 130, and the resistance value of the fur brush 42.

As stated above, by monitoring the resistance value of the secondary transcription roller 41 so as to determine a voltage applied to the fur brush 42 through the constant voltage control, it is possible to prevent occurrences of inferior cleaning of the secondary transcription roller 41, to increase the quantity of toner held in the fur brush 42, and to reduce the frequency of the cleaning of the fur brush 42.

As in the image forming apparatus having configuration shown in FIG. 1, which has been explained in the embodiment 1 of the present invention, in such a case that residual toner sticking to the secondary transcription roller 41 and cleaned off by the fur brush is from the density control patches, the timing of the density control patch is in general changed in accordance with a kind and a size of the recording medium or a number of formed images. That is, the quantity of toner fed to the fur brush is changed, depending upon a condition of image formation.

According to the present invention, the timing of application of a bias with a polarity reverse to that during normal image formation, to the fur brush is optimumly controlled in view of the relationship between the total quantity of the density control patches and the current value feed during the cleaning, for cleaning the fur brush so as to reduce the cleaning operation in which a power source of the transcription platen roller or the fur brush is changed over, or to reduce the operation of interruption of image formation. Thereby it is possible to provide an image forming apparatus, which can surely remove toner accumulated in the fur brush without reducing the throughput thereof.

Embodiment 5

An explanation has been made of the image forming apparatus in the above-mentioned embodiments of the present invention, which has the intermediate transcription belt 130 as an intermediate transcription member, the present invention should not be limited to this image formation apparatus.

Figure 5:
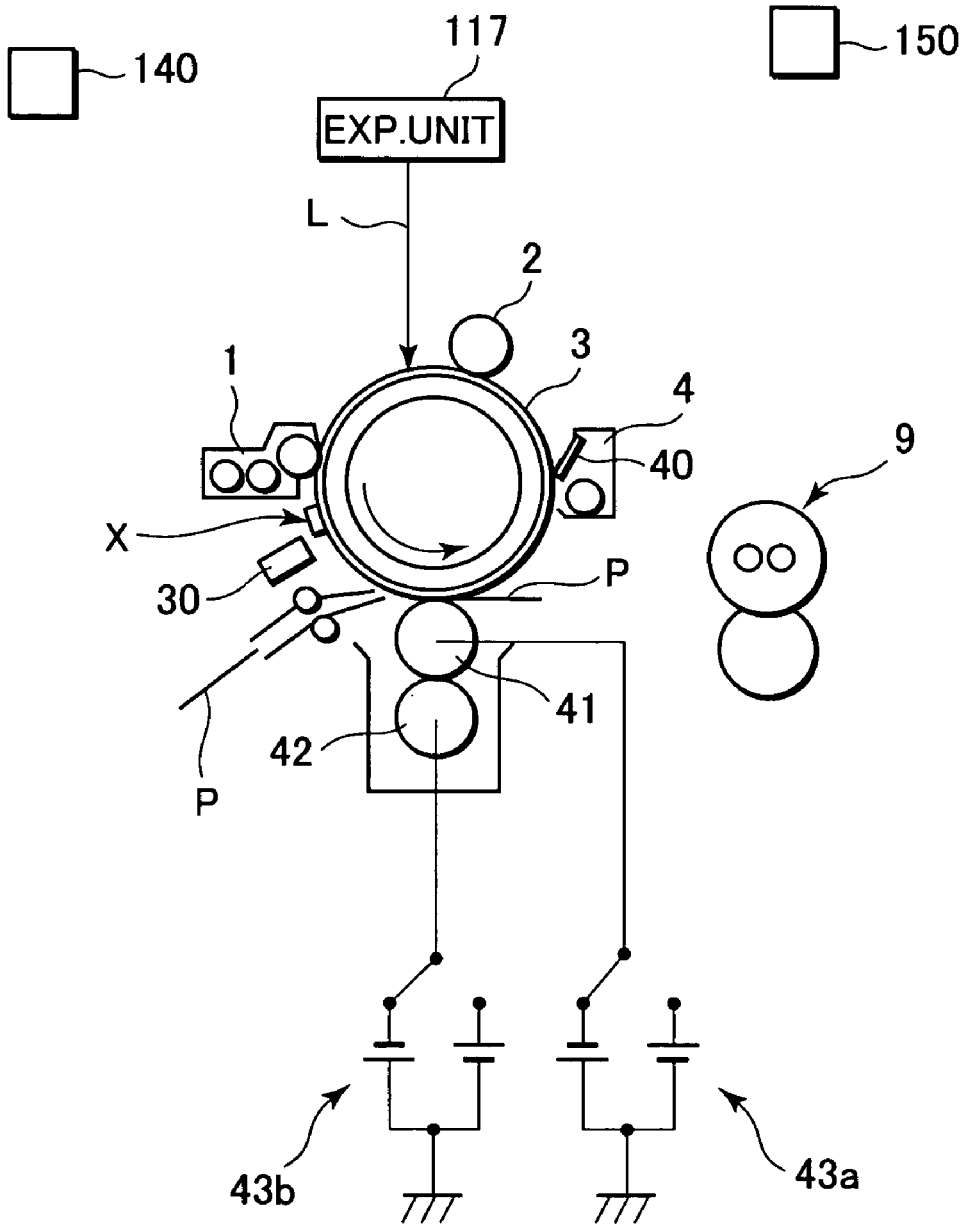
FIG. 5 is a schematic sectional view of another embodiment of the image forming apparatus according to the present invention.

Referring to FIG. 5 which shows a schematic configuration of an image forming apparatus in another embodiment of the present invention, the image forming apparatus in this embodiment is adapted to be used as an image forming apparatus of an electrophotographic type, such as a monochromatic copying machine or printer, and comprises a photosensitive drum 3 as an image bearing member which is rotatably incorporated. Process units such as an electrifier 2, a developing unit 1 and a cleaning unit are arranged around the photosensitive drum 3. The developing unit (toner image forming means) is filled therein with developer charged with negative polarity.

The photosensitive drum 3 is irradiated thereto with a laser beam L from an exposure unit 117 in accordance with an image signal from an original copy. Accordingly, an electrostatic latent image is formed on the photosensitive drum 3, which has been charged with negative polarity by the electrifier 2. Then, the electrostatic latent image on the photosensitive drum 3 is developed by the developing unit 1 so as to be visualized as a toner image charged with negative polarity.

The toner image with negative polarity, which has been visualized on the photosensitive drum 3 is transferred onto a transcription medium P which is fed with a synchronized timing, by a transcription roller (transcription member) 41 applied thereto with a transcription bias with positive polarity by a power source (electric field creating means) 43*a* when it comes to a transcription portion (transcription zone). Finally, the transcription medium P having been separated from the photosensitive drum 3 is fixed by a fixing unit 9.

Residual toner sticking to the photosensitive drum is cleaned off by the cleaning unit (image bearing member toner removing means) 4 having a cleaning blade 40.

In such an image forming apparatus, a color deviation detecting pattern image or a density detecting pattern image X composed of patches (detecting toner images) which have been formed on the photosensitive drum 3 in order to control an image, directly sticks to the outer surface of the roller 41, which is rotated making contact with the photosensitive drum 3, in the transcription portion. The toner with negative polarity in the pattern image X sticking to the roller 41 is removed by the fur brush 42 which is applied thereto with a bias with positive polarity.

In the image forming apparatus in this embodiment, a density of the image pattern composed of the patches X on the photosensitive drum 3 is detected by a density detecting sensor (toner detecting means) 30 located between the developing unit 1 and the transcription roller 41. Further, the control means 140 variably controls an image forming condition in accordance with a result of the detection by the density detecting sensor 30.

Even in the embodiment having the above-mentioned configuration, with the use of a sequence completely similar to that for the secondary transcription roller 41 in the embodiments 1 to 3, for the transcription roller 41, that is, through the execution of the sequence shown in FIG. 4, technical effects and advantages similar to those in the afore-mentioned embodiments can be obtained. That is, the fur brush 43 is applied thereto with a bias with negative polarity reverse to that during normal image formation, by the power source 43*a*. Accordingly, the toner sticking to the fur brush 42 is shifted onto the roller 41. Then, the roller 41 is also applied thereto with a bias with negative polarity reverse to that during normal image formation, by the power source 43*a*. Accordingly, the toner sticking to the roller 41 is shifted onto the photosensitive drum 3. Further, the toner having been shifted onto the photosensitive drum 3 is removed by the cleaning unit 4. Thus, the removable of the toner sticking to the fur brush 42 is completed. Further, the fur brush 42 can stably remove toner sticking to the transcription roller 41. Thereby, it is possible to surely prevent occurrences of contamination of the back surface by the transcription roller 41, and to shorten the time during post rotation.

Embodiment 6

In the afore-mentioned embodiment 5, it has been explained that the toner on the photosensitive drum 3 is cleaned off by the cleaning unit 4. However, in this embodiment, instead of the cleaning unit, there is used a so-called cleanerless system for recovering toner from the photosensitive drum 3 into the developing unit 1.

Figure 6:
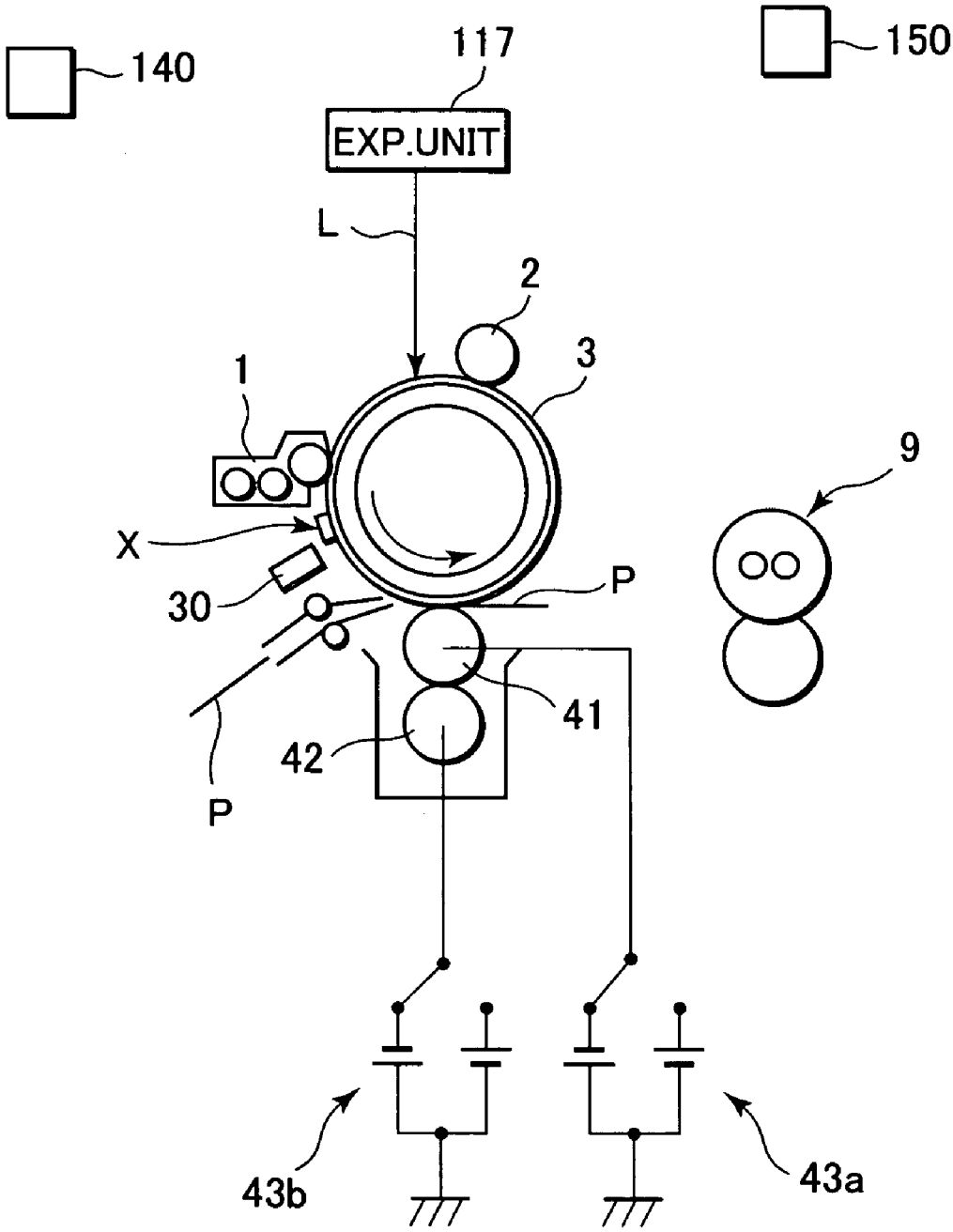
FIG. 6 is a schematic sectional view of a configuration of a further another embodiment of the image forming apparatus according to the present invention.

Referring to FIG. 6 which shows a schematic configuration of an image forming apparatus in another embodiment of the present invention, the image forming apparatus in this embodiment incorporates a photosensitive drum 3 as an image bearing member, which is rotatably arranged. Process units, such as an electrifier (electrifying means) 2, a developing unit (toner image forming means, image bearing member toner removing means) 1 are arranged around the photosensitive drum 3. The developing unit is filled therein with developer charged with negative polarity.

The photosensitive drum 3 is charged with negative polarity by the electrifier 2.

Then, the photosensitive drum 3 is irradiated thereto with a laser beam L from an exposure unit (electrostatic latent image forming means) 117 in accordance with an image signal from an original copy. Accordingly, an electrostatic latent image is formed on the photosensitive drum 3, which has been charged with negative polarity by the electrifier 2. Then, the electrostatic latent image on the photosensitive drum 3 is developed by the developing unit 1 so as to be visualized as a toner image charged with negative polarity.

The toner image with negative polarity, which has been visualized on the photosensitive drum 3 is transferred onto a transcription medium P, which is fed with a synchronized timing, by a transcription roller (transcription member) 41 applied thereto with a transcription bias with positive polarity by a power source (electric field creating means) 43*a* when it comes to a transcription portion (transcription zone). Finally, the transcription medium P having been separated from the photosensitive drum 3 is fixed by a fixing unit 9.

Residual toner sticking to the photosensitive drum is charged with negative polarity by the electrifier 2 together with the photosensitive drum 3. The photosensitive drum 3 having the toner charged with negative polarity is exposed by the exposure unit 3 so as to form an electrostatic latent image on the photosensitive drum 3. Then, when the electrostatic latent image on the photosensitive drum 3 and the toner come to the developing unit 1, the developing unit 3 causes the toner to stick to an image part of the electrostatic latent image for development so as to form a toner image while it recovers toner on non-image part of the electrostatic latent image.

In such an image forming apparatus, a color deviation detecting pattern image or a density detecting pattern image X composed of patches (detecting toner images), which have been formed on the photosensitive drum 3 in order to control an image, directly sticks to the outer surface of the roller 41, which is rotated making contact with the photosensitive drum 3, in a nip portion. The toner in the pattern image X sticking to the roller 41 is removed by a fur brush 42, which is applied thereto with a bias with positive polarity by a power source (electric field creating means) 43*b*.

In the image forming apparatus in this embodiment, a density of the image pattern composed of the patches X on the photosensitive drum 3 is detected by a density detecting sensor (toner detecting means) 30 located between the developing unit 1 and the transcription roller 41, along the photosensitive drum 3. Further, the control means 120 variably controls an image forming condition in accordance with a result of the detection by the density detecting sensor 30.

Even in the embodiment having the above-mentioned configuration, with the use of a sequence completely similar to that for the secondary transcription roller 41 in the embodiments 1 to 4, for the transcription roller 41. That is, through the execution of the sequence shown in FIG. 4, technical effects and advantages similar to those in the afore-mentioned embodiments can be obtained. That is, the fur brush 43 is applied thereto with a bias with negative polarity reverse to that during normal image formation, by the power source 43*a*, and accordingly, the toner sticking to the fur brush 42 is shifted onto the roller 41, being charged by the electrifier 3. Then, the roller 41 is also applied thereto with a bias with negative polarity reverse to that during normal image formation, by the power source 43*a*. Accordingly, the toner sticking to the roller 41 is shifted onto the photosensitive drum 3. Further, the toner having been shifted onto the photosensitive drum 3 is recovered into the developing unit 1, being charged by the electrifier 2. Thus, the removable of the toner accumulated in the fur brush 42 is completed. Further, the fur brush 42 can stably remove toner sticking to the transcription roller 41. Thereby, it is possible to surely prevent occurrences of contamination of the back surface by the transcription roller 41, and to shorten the time during post-rotation.

It is noted that the toner image quantity as a condition for determining a timing with which the operation of cleaning the fur brush corresponds to a number of times of formation of the density control patches in the above-mentioned embodiments 1 to 6. That is, a number of formed density control patches. However, the toner quantity should not be limited this number of times, but it may correspond to a condition correlating to the toner quantity sticking to the fur brush, such as a video count value or an image rate of a normally formed image formed on the intermediate transcription belt 130 or the photosensitive drum 3. Further, the condition for determining the timing with which the operation of cleaning the fur brush is carried out may include a parameter due to a variation in the environment of use of the apparatus, in addition to the condition correlating to the quantity of toner sticking to the fur brush. Further, it may be adjusted in accordance with data of a sheet size or image data.

While the present invention has been described with reference to exemplary embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

This application claims priority from Japanese Patent Application No. 2004-171182 filed Jun. 9, 2004, which is hereby incorporated by reference herein.

What is claimed is:

1. An image forming apparatus comprising:

an image bearing member for bearing a toner image;

toner image forming means for forming the toner image on said image bearing member, the toner image forming means being capable of forming an adjustment toner image, which is not transferred onto a recording medium, on the image bearing member during non-image forming period;

a transfer member, provided in contact with said image bearing member, for electrostatically transferring the toner image on said image bearing member onto a recording medium;

a detecting member for detecting said adjustment toner image;

a controller for adjusting toner image forming conditions of said toner image forming means on the basis of an output by said detecting member; and a cleaning member, provided in contact with said transfer member, for removing toner on said transfer member, said cleaning member executing a discharge mode for electrostatically discharging the removed toner to said image bearing member via said transfer member at a predetermined timing, wherein an amount of toner of the formed adjustment toner image is summed, and the predetermined timing is changed based on the summed toner amount.

2. The image forming apparatus according to claim 1, wherein as the amount of toner forming the adjustment toner image becomes smaller, the interval between executions of the discharge mode becomes longer.

3. The image forming apparatus according to claim 1, wherein a voltage having polarity reverse to a polarity of the toner is applied to said cleaning member when the toner image is formed on the recording medium, and a voltage having the same polarity as the polarity of the toner is applied to said cleaning member when a discharge mode is executed.

4. The image forming apparatus according to claim 1, wherein the adjustment toner image is formed when no image is formed during an interval between image-forming operations in a continuous image-forming operation.

5. The image forming apparatus according to claim 1, further comprising a second cleaning member, provided in contact with said image bearing member, for removing toner on said image bearing member.

* * * * *